US006338417B1

(12) United States Patent
Ferraro

(10) Patent No.: US 6,338,417 B1
(45) Date of Patent: Jan. 15, 2002

(54) FOOD CONTAINER

(76) Inventor: Daniela M. C. Ferraro, Via Sarno 75, I-80040 Striano (Napoli) (IT)

( * ) Notice: Subject to any disclaimer, the term of this patent is extended or adjusted under 35 U.S.C. 154(b) by 0 days.

(21) Appl. No.: 09/555,226

(22) PCT Filed: Nov. 25, 1998

(86) PCT No.: PCT/EP98/07615

§ 371 Date: May 26, 2000

§ 102(e) Date: May 26, 2000

(87) PCT Pub. No.: WO99/26847

PCT Pub. Date: Jun. 3, 1999

(30) Foreign Application Priority Data

Nov. 26, 1997 (IT) ..... T097A1033

(51) Int. Cl.[7] ..... B65D 85/72; A47G 19/22

(52) U.S. Cl. ..... 220/23.83; 220/23.86; 220/212; 220/287; 220/703; 220/709; 426/120; 206/217

(58) Field of Search ..... 220/212, 23.83, 220/23.86, 503, 505, 521, 287, 703, 705, 709; 206/217, 216, 541; 426/120, 115

(56) References Cited

U.S. PATENT DOCUMENTS

| | | | | |
|---|---|---|---|---|
| 1,665,289 A | * | 4/1928 | Weaver | |
| 5,180,079 A | * | 1/1993 | Jeng | 220/212 |
| 5,573,131 A | * | 11/1996 | Berjis | 220/710 |
| 5,678,720 A | * | 10/1997 | Van Melle | 220/287 |
| 5,695,086 A | * | 12/1997 | Viola | 220/287 |

FOREIGN PATENT DOCUMENTS

| | | | |
|---|---|---|---|
| FR | 2608131 | * | 6/1988 |
| FR | 2649080 | * | 1/1991 |
| GB | 2023407 | * | 1/1980 |
| JP | 6-227585 | * | 8/1994 |

* cited by examiner

*Primary Examiner*—Nathan J. Newhouse
(74) *Attorney, Agent, or Firm*—Sughrue Mion, PLLC

(57) ABSTRACT

A food container is superimposed onto the upper end of a beverage receptacle. The container has a side wall and bottom wall in which there is formed at least one channel to allow the passage out through the container of a drinking straw which penetrates into the receptacle. The bottom wall is provided with a plurality of connectors for allowing connection of the food container to receptacles of different sizes at their upper end.

4 Claims, 4 Drawing Sheets

FOOD CONTAINER

BACKGROUND OF THE INVENTION

The present invention relates to a food container which can be superimposed over the upper end of a beverage receptacle, and to an assembly comprising the food container and the beverage receptacle.

In more detail, such container has a side wall and a bottom wall, in which is formed at least one channel to allow the passage through the cover of a drinking straw which extends into the beverage receptacle.

Containers of this general type are known, for example, from prior art documents GB-k-2 023 407, FR-A-2 649 080 and FR-A-2 733 403. They allow a consumer to carry both solid foods and drinks ready for consumption together using only one hand without having recourse to difficult manipulations or external supports.

Such containers are therefore particularly suitable for use in fast food restaurants in which structures such as chairs and tables which allow the user consume meals in a seated position are not provided.

The above-mentioned known containers are made in such a way that they can be associated with a single type of receptacle having an upper end of well defined dimensions.

In practice, however, in an individual restaurant establishment drinks are sold in various types of containers, for example metal cans and cups of plastics material, which are decidedly different from one another. Moreover even containers of the same type can have very different capacities, varying for example from 0.1 to 1 litre and therefore decidedly different dimensions at the upper end.

This causes the disadvantages that the individual restaurant establishment must be provided with different types of containers which can be associated with different receptacles and which the staff must chose upon sale to select the container suitable for accompanying the receptacle sold at any one time.

SUMMARY OF THE INVENTION

For the purpose of obviating these disadvantages the object of the present invention is a container and an assembly formed by this latter and a receptacle associated with it, having the characteristics indicated in the following claims.

An individual container according to the invention can be associated with receptacle having different dimensions at the upper end. This allows restaurants to hold stocks of containers of only a single dimension with an evident saving in storage costs. At the same time the operations of the staff upon sale are speeded up since these latter do not have to choose the size of the container to couple to a given receptacle.

The container of the invention can be produced of any conventional material, for example plastics or cardboard, with the use of known technologies, for example thermoforming.

Advantageously, the containers of the invention can be stacked on one another so as to reduce the costs of transport and storage.

BRIEF DESCRIPTION OF THE DRAWINGS

Further advantages and characteristics of the present invention will become apparent from the following detailed description, given with the aid of the attached drawings and provided purely by way of non-limitative example, in which.

Figure 1:
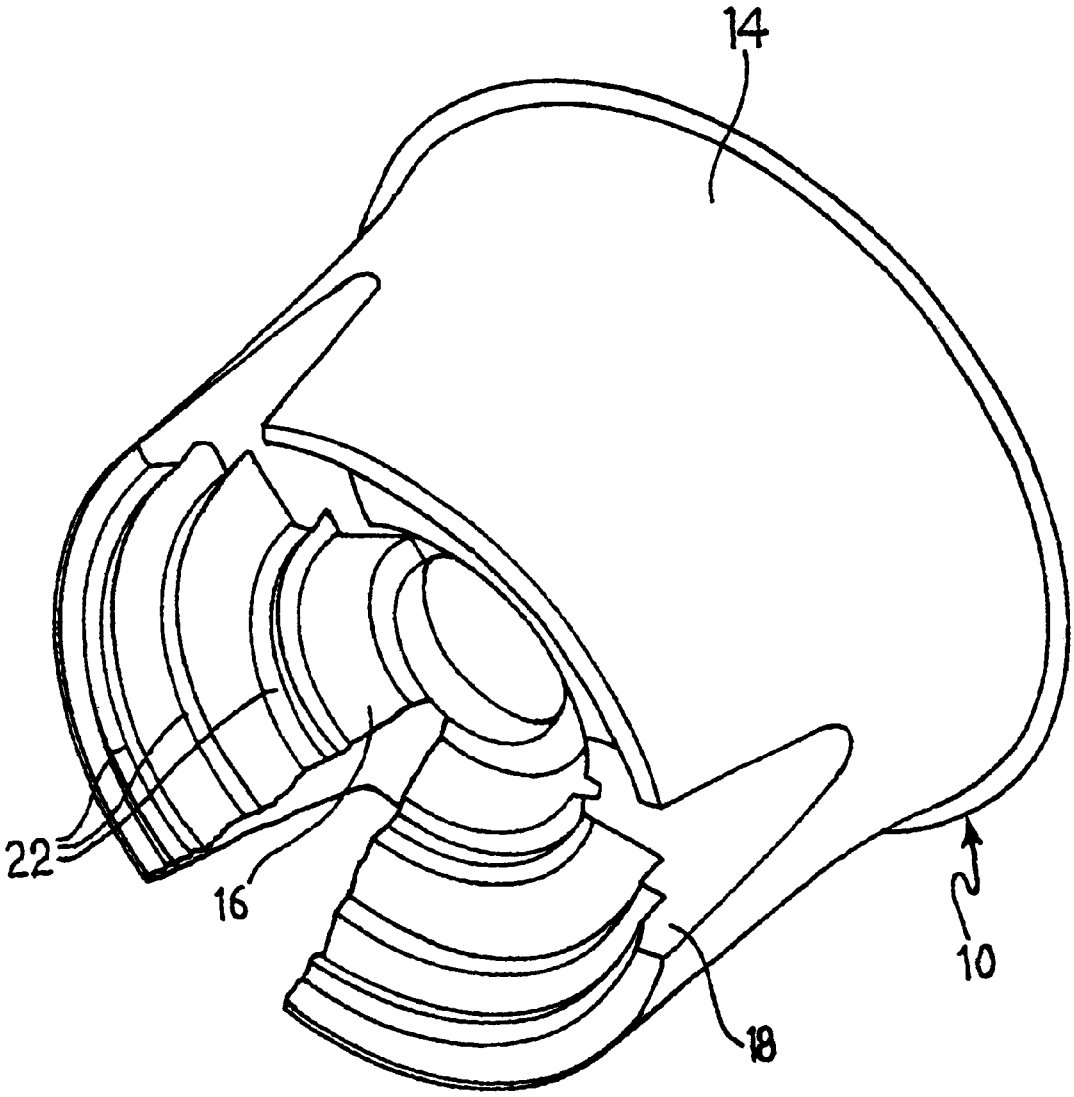
FIG. 1 is a perspective view from below of a container according to the invention.
Figure 2:
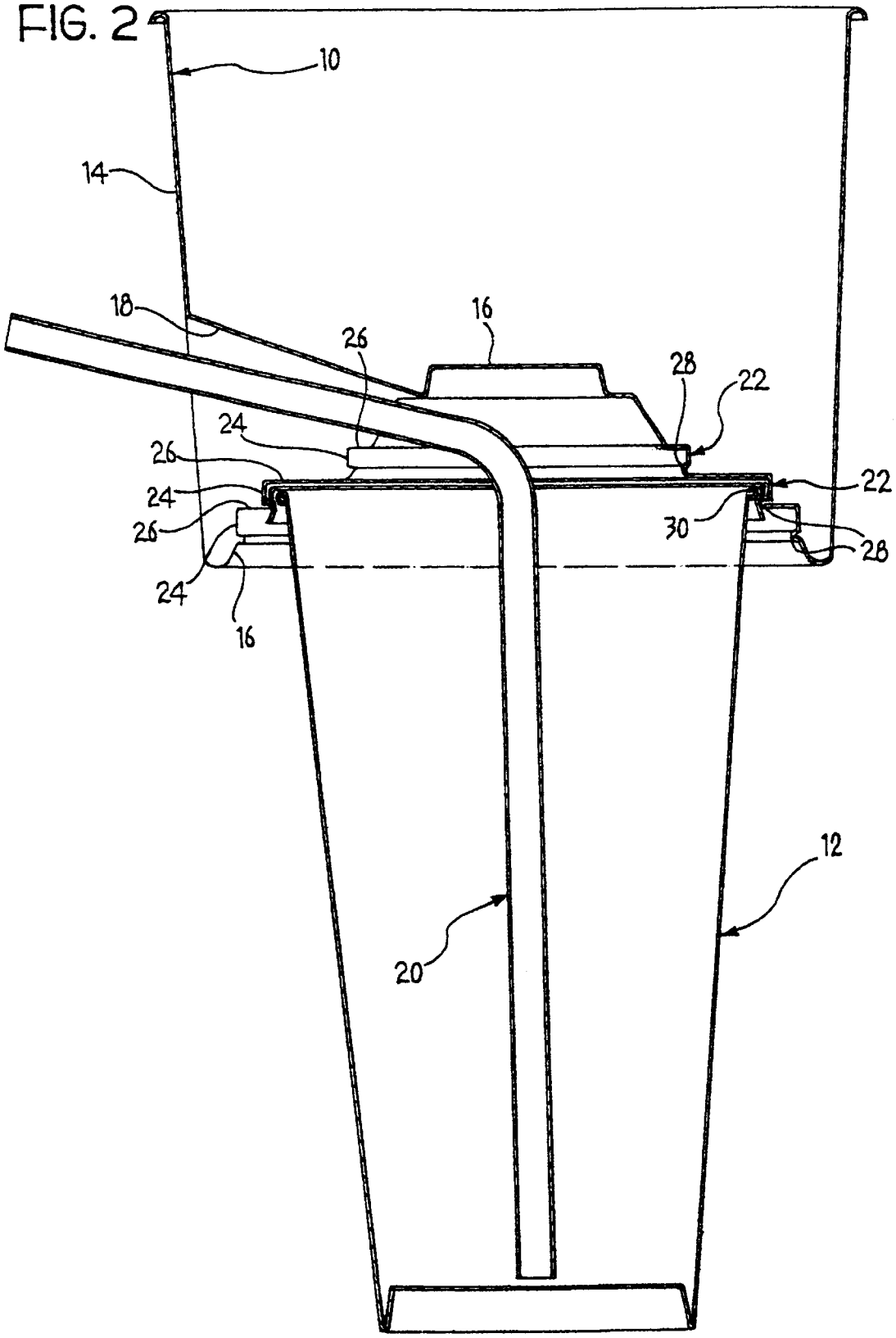
FIG. 2 is side elevation of the container of FIG. 1 associated with a receptacle.

A food container 10 which can be superimposed over the upper end of a beverage receptacle, for example a cup 12 such as that illustrated in FIG. 2, has (FIGS. 1 and 2) a slightly frusto-conical side wall 14 and a bottom wall 16.

DETAILED DESCRIPTION OF THE INVENTION

In the walls 14, 16 there are formed a plurality of circumferentially off-set channels 18 to allow the passage out through the cover 10 of a drinking straw 20 which extends into the receptacle 12.

The bottom wall 16 has a cavity with a generally upwardly tapered frusto-conical profile, in which there are formed three steps 22 which extend circumferentially and comprise a vertical or riser part 24 and a horizontal part 26.

The riser 24 of each step 22 has, at its lower end, a projection 28 to form an undercut.

On the outside of the side wall 14 there may be provided decorations and/or advertising messages.

To fit the container 10 to the receptacle 12 the upper end of this latter is pressed axially against the bottom wall 16 of the container 10 until reaching a step 22 of dimensions corresponding, for example, to that in an intermediate position (see FIG. 2).

The edge 30 of the upper end, which projects radially with respect to the body of the container, causes a slight elastic divergence of the projection 28 from the riser 24 of this step 22, which, upon further movement in an axial direction of the receptacle 12, returns into its original position lying alongside the edge 30. Alternatively, depending on the relative rigidity of the projection 28 and the edge 30, it is possible that this latter may be subject to a slight elastic contraction following the axial movement of the drinks container 12.

In either case a stable connection of the receptacle 12 to the container 10 is produced, in particular one which cannot be separated by the effect of the force of gravity alone, thus allowing a secure manipulation of the assembly constituted by these two elements.

Subsequently the drinking straw 20 is introduced into one of the channels 18, which straw can thus penetrate into the receptacle 12 dipping into the liquid contained in it and making it accessible to a consumer.

Solid foods contained in the container 10 are on the other hand directly accessible through the upper opening of this latter.

The assembly formed by the container 10 and the receptacle 12 therefore allows the user to carry both the solid foods held in the container 10 and the drinks held in the receptacle 12 both together using only one hand, both ready for consumption without having recourse to difficult manipulations or external supports.

Figure 3:
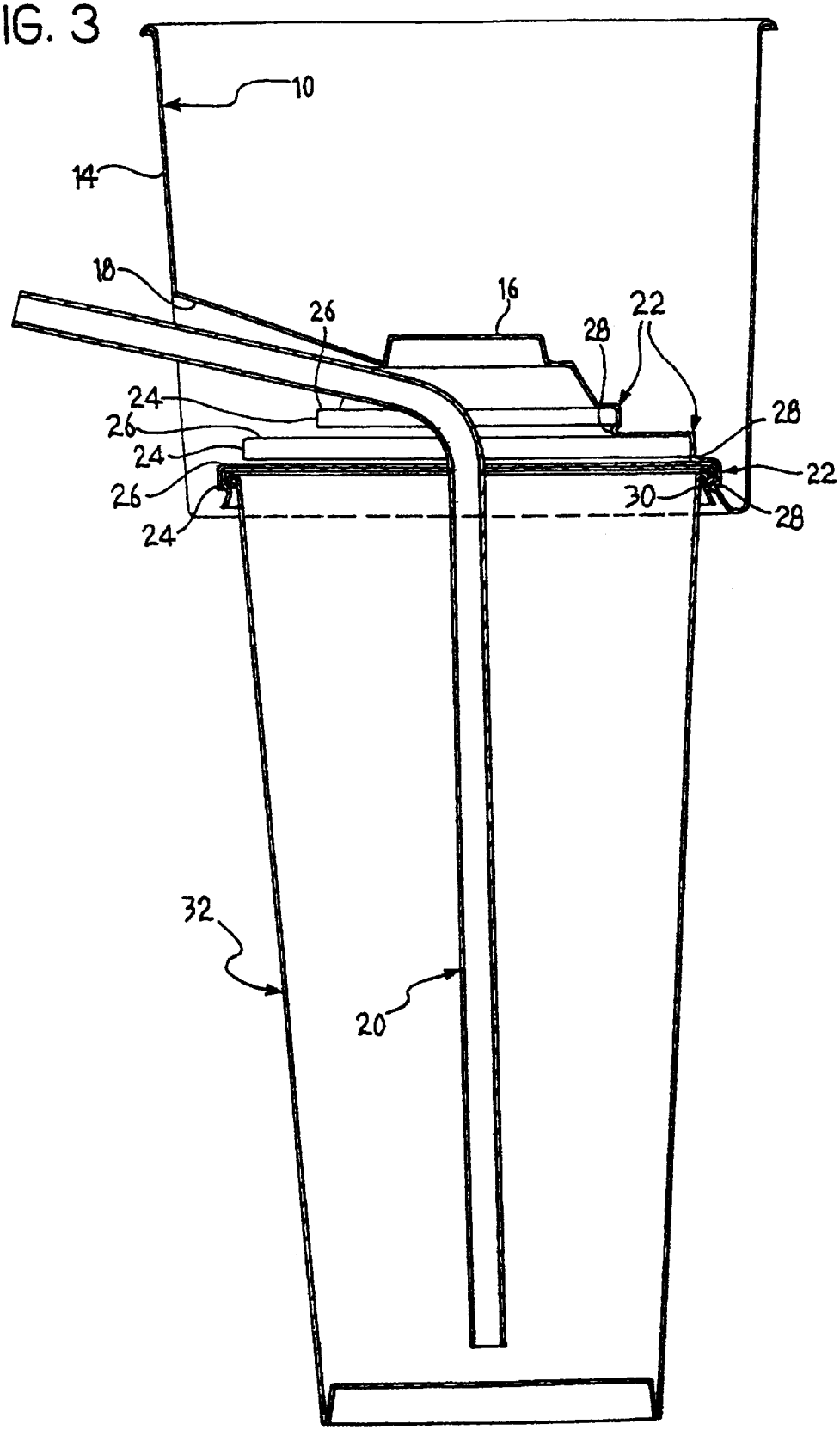
FIGS. 3 and 4 are side elevations of the container of FIG. 1 associated with different receptacles.
Figure 4:
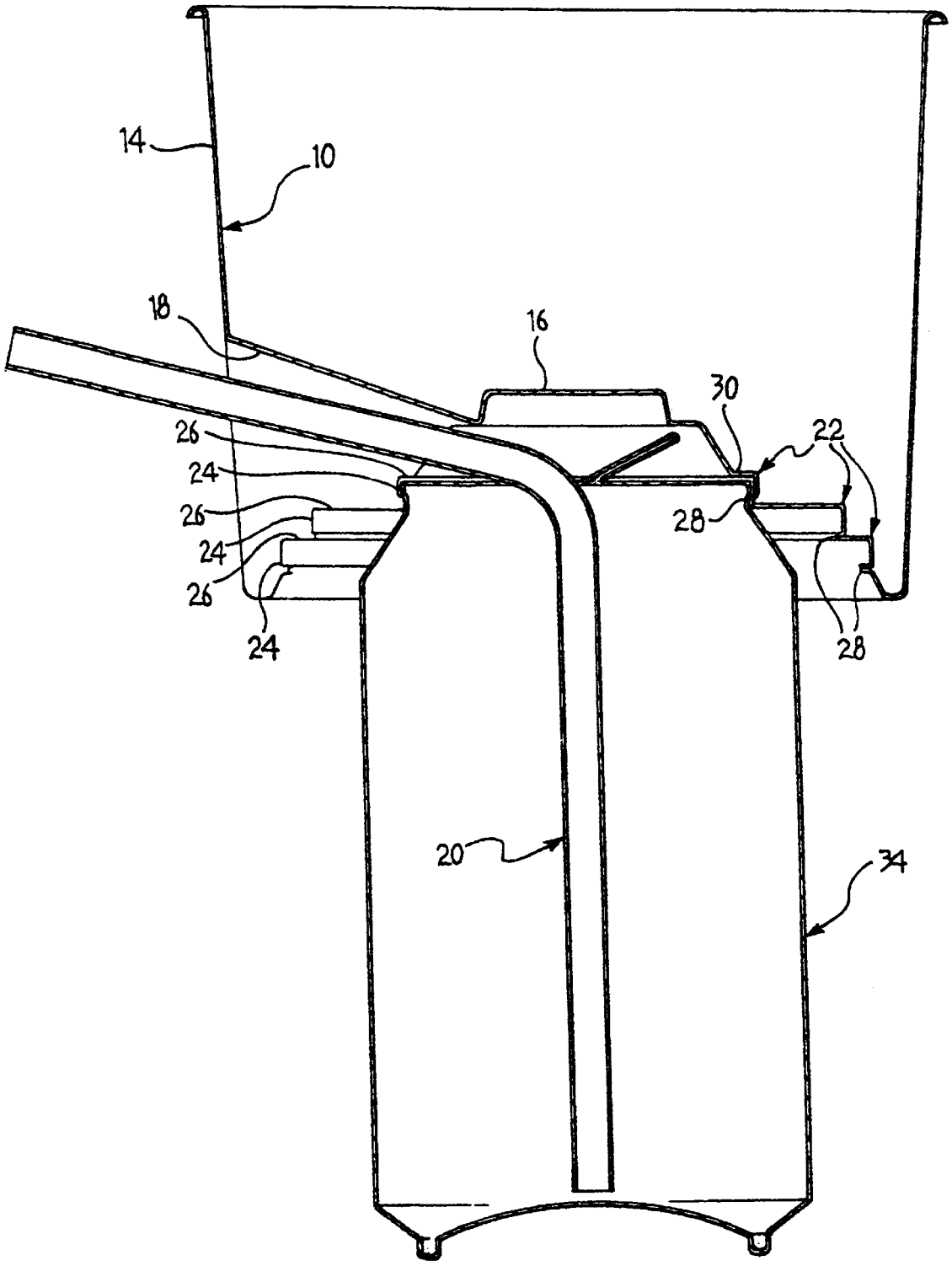

Obviously, whenever it is desired to connect the container 10 to a receptacle of different dimensions the same operations as those described above would be effected with the difference that the edge of the receptacle would become engaged by a different step 22 of the bottom wall 16. This can be seen by way of example in FIGS. 3 and 4, in which the container 10 is respectively connected to a cup 32 of greater dimensions than that illustrated in FIG. 2, and a can 34.

Generally, therefore, the steps 22 serve as means able to allow the connection of the container 10 to receptacles 12, 32, 34 having different dimensions at the upper end.

Naturally, it is intended that, the principle of the invention remaining the same, the details of construction and the embodiments can be widely varied with respect to what has been described and illustrated in the drawings, without by this departing from the ambit of the present invention.

For example, in the bottom wall 16 of the container 10 there may, in principle, be provided any number of steps 22 so as to allow coupling with a corresponding number of receptacles having upper ends of different dimensions. These steps can moreover have a plan form other than circular, for example rectangular or square, to allow coupling with a receptacle, for example, of parallelepiped form.

What is claimed is:

1. A food container (10) which can be superimposed over the upper end of a beverage receptacle (12, 32, 34) said container (10) having a side wall (14) and a bottom wall (16) in which there is formed at least one channel (18) to allow the passage out through the container (10), of a drinking straw (20) which extends into the receptacle (12, 32, 34), said container (10) wherein said bottom wall (16) is provided with means for allowing the container (10) to be connected to a receptacle (12, 32, 34) selected from at least two receptacles having different dimensions at the upper end;

wherein said means allow a stable connection of the container (10) to a receptacle (12, 32, 34) chosen from at least two receptacles having different upper end dimensions, in particular a connection which is not separated by the force of gravity alone;

wherein said bottom wall (16) has a cavity with a generally frusto-conical upwardly tapered profile, in which there are formed at least two steps (22) which extend circumferentially and which comprise a vertical or riser part (24) and a horizontal part (26);

wherein said riser (24) has, at its lower end, a projection (28) to form an undercut so as to allow engagement of the edge (30) of the upper end of the receptacle (12, 32, 34) and its stable connection to the container (10), and wherein the projection to form an undercut is circumferentially continuous except for the presence of the at least one channel.

2. A container (10) according to claim 1 wherein said bottom wall (16) is provided with means to allow the connection of the food container (10) to a receptacle (12, 32, 34) chosen from a plurality of receptacles having different upper end dimensions.

3. A container (10) according to claim 1, wherein said bottom wall (16) has a plurality of steps (22) formed therein.

4. A container (10) according to claim 1, wherein the side walls (14) and bottom wall (16) of the container (10) have a plurality of circumferentially off-set channels (18) formed therein to allow the passage out through the container (10) of a drinking straw (20) which penetrates into the receptacle (12, 32, 34).

* * * * *